US010359052B2

(12) United States Patent
Behnke

(10) Patent No.: US 10,359,052 B2
(45) Date of Patent: Jul. 23, 2019

(54) VERTICAL PUMP HAVING DISCHARGE HEAD WITH FLEXIBLE ELEMENT

(71) Applicant: ITT MANUFACTURING ENTERPRISES LLC., Wilmington, DE (US)

(72) Inventor: Paul W. Behnke, Seal Beach, CA (US)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 692 days.

(21) Appl. No.: 14/163,235

(22) Filed: Jan. 24, 2014

(65) Prior Publication Data

US 2015/0211550 A1 Jul. 30, 2015

(51) Int. Cl.

| | |
|---|---|
| ***F04D 29/62*** | (2006.01) |
| ***F04D 13/02*** | (2006.01) |
| ***F04D 29/52*** | (2006.01) |
| ***F04D 29/54*** | (2006.01) |
| ***F04D 29/66*** | (2006.01) |
| ***F04D 13/10*** | (2006.01) |
| *F04D 29/08* | (2006.01) |
| *F04D 29/046* | (2006.01) |

(52) U.S. Cl.

CPC ..... *F04D 29/628* (2013.01); *F04D 13/02* (2013.01); *F04D 13/10* (2013.01); *F04D 29/528* (2013.01); *F04D 29/548* (2013.01); *F04D 29/669* (2013.01); *F04D 29/046* (2013.01); *F04D 29/083* (2013.01)

(58) Field of Classification Search

CPC ..... F04D 29/628; F04D 13/02; F04D 29/528
See application file for complete search history.

(56) References Cited

U.S. PATENT DOCUMENTS

| | | | | |
|---|---|---|---|---|
| 3,071,296 | A | 1/1963 | Frey et al. | |
| 2009/0180874 | A1 | 7/2009 | Gutierrez et al. | |
| 2011/0146049 | A1* | 6/2011 | Hagiya | F16L 27/108 29/446 |

FOREIGN PATENT DOCUMENTS

| | | | |
|---|---|---|---|
| CN | 1044897 | A1 | 8/1990 |
| CN | 101126474 | A * | 2/2008 |
| CN | 201568317 | A | 9/2010 |
| CN | 103206606 | A | 7/2013 |
| DE | 202004007525 | | 7/2004 |
| JP | H0886295 | A * | 2/1996 |

(Continued)

OTHER PUBLICATIONS

English Translation CN 101126474A.*

(Continued)

*Primary Examiner* — Mark A Laurenzi
*Assistant Examiner* — Shafiq Mian
(74) *Attorney, Agent, or Firm* — Moritt Hock & Hamroff LLP; Bret P. Shapiro

(57) ABSTRACT

A discharge head features at least one low-deflection component that substantially does not deflect in response to high piping forces applied in a direction perpendicular to the discharge head; at least one high-deflection component that deflects in response to the high piping forces; and a flexible element configured between the at least one low-deflection component and the at least one high-deflection component to contain pressure and to be highly flexible in the direction perpendicular to the centerline of the discharge head.

2 Claims, 6 Drawing Sheets

(56) References Cited

FOREIGN PATENT DOCUMENTS

| | | | |
|---|---|---|---|
| JP | H0886295 | | 4/1996 |
| JP | 2008121603 | A | 5/2008 |
| RU | 2501981 | C2 | 12/2013 |

OTHER PUBLICATIONS

English Translation JPH0886295A.*
JPH0886295 English Language Abstract (1 page).
DE202004007525 English Language Abstract (1 page).
English language Abstract of CN201568317U.
English language Abstract of CN103206606A.
English language Abstract of CN1044897A.
English language Abstract of RU2501981.
English language Abstract of JP2008121603.

* cited by examiner

*FIG. 1A*: (Prior Art) Typical Pump and Ordinary Discharge Head Design

| | |
|---|---|
| 1a | CAPSCREW–MOTOR/SUPPORT |
| 1b | SOC. HD. CAPSCREW |
| 1c | HEX NUT |
| 1d | MOTOR SUPPORT |
| 1e | SOC. HD. CAPSCREW |
| 1f | HEX NUT |
| 1g | COUPLING GUARD |
| 1h | STUD & NUT SEAL/HOUSING |
| 1i | CAPSCREW–SUPPORT/HEAD |
| 1j | PIPE PLUG (SUPPORT DRAIN) |
| 1k | O–RING/GASKET–HOUSING/HEAD |
| 1l | BEARING–SEAL HOUSING |
| 1m | BY PASS LINE ASSEMBLY (TUBE & FITTINGS OR PIPE & FLANGES) |
| 1n | MOUNTING HOLES |
| 1o | BY PASS RETURN TO SUMP |
| 1p | SOC. HD. CAPSCREW |
| 1q | THRUST RING |
| 1r | WEAR RING–BOWL (OPTIONAL) |
| 1s | WEAR RING–IMPELLER (OPTIONAL) |
| 1t | KEY–IMPELLER |
| 1u | IMPELLER |
| 1v | SAND COLLAR (OPTIONAL |
| 1w | BEARING–SUCTION |
| 1x | PIPE PLUG (OPTIONAL) |
| 1y | VERTICAL SOLID SHAFT MOTOR |
| 1z | MOTOR KEY (SUPPLIED BY MOTOR VENDOR) |
| 2a | HUB–MOTOR |
| 2b | RING–RETAINING |
| 2c | SPACER |
| 2d | PLATE–ADJUSTING |
| 2e | HUB–PUMP |
| 2f | PUMP KEY |
| 2g | MECHANICAL SEAL |

| | |
|---|---|
| 2h | O–RING/GASKET–SEAL/HOUSING |
| 2i | STUD & NUT–HOUSING/HEAD |
| 2j | HOUSING–SEAL |
| 2k | HEAD |
| 2l | HEADSHAFT |
| 2m | HEX NUT–COL/HEAD |
| 2n | STUD–COL/HEAD |
| 2o | COLUMN–TOP (COLUMN BEARING IS OPTIONAL) |
| 2p | CAPSCREW–COL/COL |
| 2q | HEX NUT–COL/COL |
| 2r | COLUMN–IMTERMEDIATE |
| 2s | LINESHAFT |
| 2t | O–RING–COL/COL/HEAD (OPTIONAL) |
| 2u | BEARING–LINESHAFT |
| 2v | COLUMN–BOTTOM |
| 2w | THREADED COUPLING–LINESHAFT (OR KEYED COUPLING) |
| 2x | PUMPSHAFT |
| 2y | HEX NUT–COL/BOWL |
| 2z | CAPSCREW–COL/BOWL |
| 3a | BEARING–BOWL |
| 3b | BOWL–TOP |
| 3c | CAPSCREW–BOWL/BOWL |
| 3d | BOWL–INTERMEDIATE |
| 3e | O–RING–BELL/BOWL/BOWL (OPTIONAL) |
| 3f | CAPSCREW–BOWL/BELL |
| 3g | CAPSCREW–STRAINER |
| 3h | SUCTION BELL |
| 3i | STRAINER–BASKET TYPE (OPTIONAL) |

*FIG. 1B*: (Prior Art) Index of Components of Pump Shown in FIG. 1A

*FIG. 2*: Discharge Head with Flexible Element

| BM ITEM | DESCRIPTION |
|---|---|
| 101 | COUPLING – SHAFT |
| 102 | PACKING |
| 103 | HEX NUT |
| 104 | HEX NUT |
| 105 | HEX NUT CAPSCREW |
| 106 | HEX NUT CAPSCREW |
| 107 | HEX NUT CAPSCREW |
| 108 | HEX NUT CAPSCREW |
| 109 | HEX NUT CAPSCREW |
| 110 | HEX NUT CAPSCREW |
| 111 | WASHER, NARROW, 1/2 BOLT |
| 112 | WASHER, NARROW, 5/8 BOLT |
| 113 | WASHER, NARROW, 3/4 BOLT |
| 114 | WASHER, NARROW, 1–1/4 BOLT |
| 115 | THREADED LINESHAFT |
| 116 | THREADED LINESHAFT |
| 117 | BEARING, BRONZE |
| 118 | HEAD EXPANSION JOINT 6" |
| 119 | GASKET |
| 120 | SPLIT GLAND – 1–15/16 DIA SHAFT |
| 121 | WASHER – STUFFING BOX |
| 122 | STUFFING BOX |
| 123 | O–RING |
| 124 | O–RING |
| 125 | 24 INCH TEST HEAD |
| 126 | BOWL ASSEMBLY – IMPELLER 001, 24YDD |
| 127 | COLUMN TAPERED 24YDD |
| 128 | CWP TEST BASE |
| 129 | CWP TOP COLUMN ASSY |
| 130 | BEARING |
| 131 | 59" MOTOR SHAFT |
| 132 | MOTOR |
| 133 | STUDS – CONTINUOUS THREADS |

*FIG. 4B*

VERTICAL PUMP HAVING DISCHARGE HEAD WITH FLEXIBLE ELEMENT

BACKGROUND OF THE INVENTION

1. Field of the Invention

The present invention relates to a discharge head; and more particularly to a discharge head for a vertically suspended pump type.

2. Brief Description of Related Art

By way of example, FIG. 1A shows a known vertically suspended pump type and includes reference designations of various parts and components that make up the same. Vertically suspended pumps are known in the art which operate in an upright position and employ a bowl assembly including a rotary impeller submerged in a body of liquid or fluid to be pumped. By way of further example, the reader is also referred to U.S. Pat. No. 8,226,352, which discloses a discharge head for configuring in such a vertically suspended pump type, which is assigned to the assignee of the present invention, and hereby incorporated by reference in its entirety.

In operation, discharge heads of vertical pumps are often subjected to high piping forces from expanding pipe joints at the connection between the piping and pump discharge flange. These expanding pipe joints are designed to be flexible and are typically constructed of rubber elements. The high piping forces which occur in the direction perpendicular to the face of the pump discharge flange are the result of elastic expansion of the expanding pipe joint elements along their centerline axis when pressurized. When flexible pipe joints are used, these forces are approximately equal to the discharge pressure times the projected area of the inside diameter of the joint. For example, a 36-inch diameter expanding pipe joint pressurized to 100 psig produces a piping force equal to 101,736 lbf acting horizontally against the pump discharge head.

High piping forces applied against standard discharge head designs cause material deflection of the discharge head which in turn causes misalignment of the stationary bearings mounted in the discharge head from the rotating shaft of the pump. This internal pump misalignment causes high mechanical vibration and contact wear between the bearings and bearing journals on the shaft. As a result, pump life is shortened.

There is a need in the industry for a discharge head design that reduces the undesirable effects from high piping forces, including misalignment of the bearings mounted in the discharge head from the rotating shaft of the pump and high mechanical vibration and contact wear between the bearings and bearing journals on the shaft.

SUMMARY OF THE INVENTION

This present invention provides a new and unique discharge head design, which separates one set of flexible components of the discharge head which deflect under the high piping forces from another set of rigid components of the discharge head which support one or more bearings. The flexible components which deflect are the pump discharge flange and the discharge elbow, and the rigid components which support the one or more bearings are the motor supports and the bearing housings. A flexible element may be inserted between the flexible and rigid components of the discharge head so that the deflection of the former is not communicated to the latter. The flexible components may be designed to contain pressure and to be highly flexible in the direction perpendicular to the centerline of the discharge head, which is the direction of the high piping force. The rigid components may be design to maintain internal pump alignment and product life is improved.

When this innovative discharge head design with flexible element design is used in vertically suspended pump types, the benefits may include the following:

- Customer installation costs are reduced because allowable piping forces on the pumps can be increased.
- Pump weights are reduced because discharge elbows are designed based solely on material stress values and not based on restraining deflections.
- Pump mechanical vibration and rates of wear are reduced because internal alignment at bearings is maintained under high pipe forces.
- Pump life cycles are increased because vibration and rates of wear are reduced.

EXAMPLES OF PARTICULAR EMBODIMENTS

The present invention provides a new and unique discharge head featuring at least one low-deflection component that substantially does not deflect in response to high piping forces applied in a direction perpendicular to the discharge head; at least one high-deflection component that deflects in response to the high piping forces; and a flexible element configured between the at least one low-deflection component and the at least one high-deflection component to contain pressure and to be highly flexible in the direction perpendicular to the centerline of the discharge head.

According to some embodiments of the present invention, the discharge head may include one or more of the features, as follows:

The at least one high-deflection component may include some combination of a pump discharge flange and a discharge elbow.

The at least one low-deflection component may include components which support one or more bearings, including some combination of motor supports and a bearing housing.

The flexible element may be configured or inserted between the at least one low-deflection component and the at least one high-deflection component, so that the deflection of the at least one high-deflection component is not substantially communicated to the at least one low-deflection component.

The flexible element may be configured as a bellows-like flexible structure and made from any flexible material, including elastomers and metals.

The discharge head may include a mounting plate and a base plate, and the motor supports may be configured to couple the mounting plate and the base plate.

The discharge head may include rib supports, and the bearing housing may be configured or coupled to the rib supports.

The discharge elbow may be coupled to the base plate.

The flexible element may be configured to couple the bearing housing to the discharge elbow.

According to some embodiments, the present invention may also take the form of a vertical pump featuring a first pump arrangement, a second pump combination and the new and unique discharge head. The first pump arrangement may include a vertical solid shaft motor configured on a motor support for rotating a drive shaft. The second pump combination may include a column arranged about the drive shaft, and also include a bowl assembly having a rotary impeller coupled to the drive shaft. Consistent with that set forth herein, the new and unique discharge head may be configured to couple the motor support of the first pump arrangement and the column of the second pump arrangement. The discharge head may also include at least one low-deflection component that substantially does not deflect in response to high piping forces applied in a direction perpendicular to a centerline of the discharge head; at least one high-deflection component that deflects in response to the high piping forces; and a flexible element configured between the at least one low-deflection component and the at least one high-deflection component to contain pressure and to be highly flexible in the direction perpendicular to the centerline of the discharge head. The flexible element may also be configured so an internal pump alignment of the vertical pump is substantially maintained.

BRIEF DESCRIPTION OF THE DRAWING

The drawing includes FIGS. 1A-4B, which are not necessarily drawn to scale:

FIG. 4B is an index containing a list of the components by item no. and a description for the vertically suspended pump shown in FIG. 4B.

DETAILED DESCRIPTION OF THE INVENTION

Figure 1:
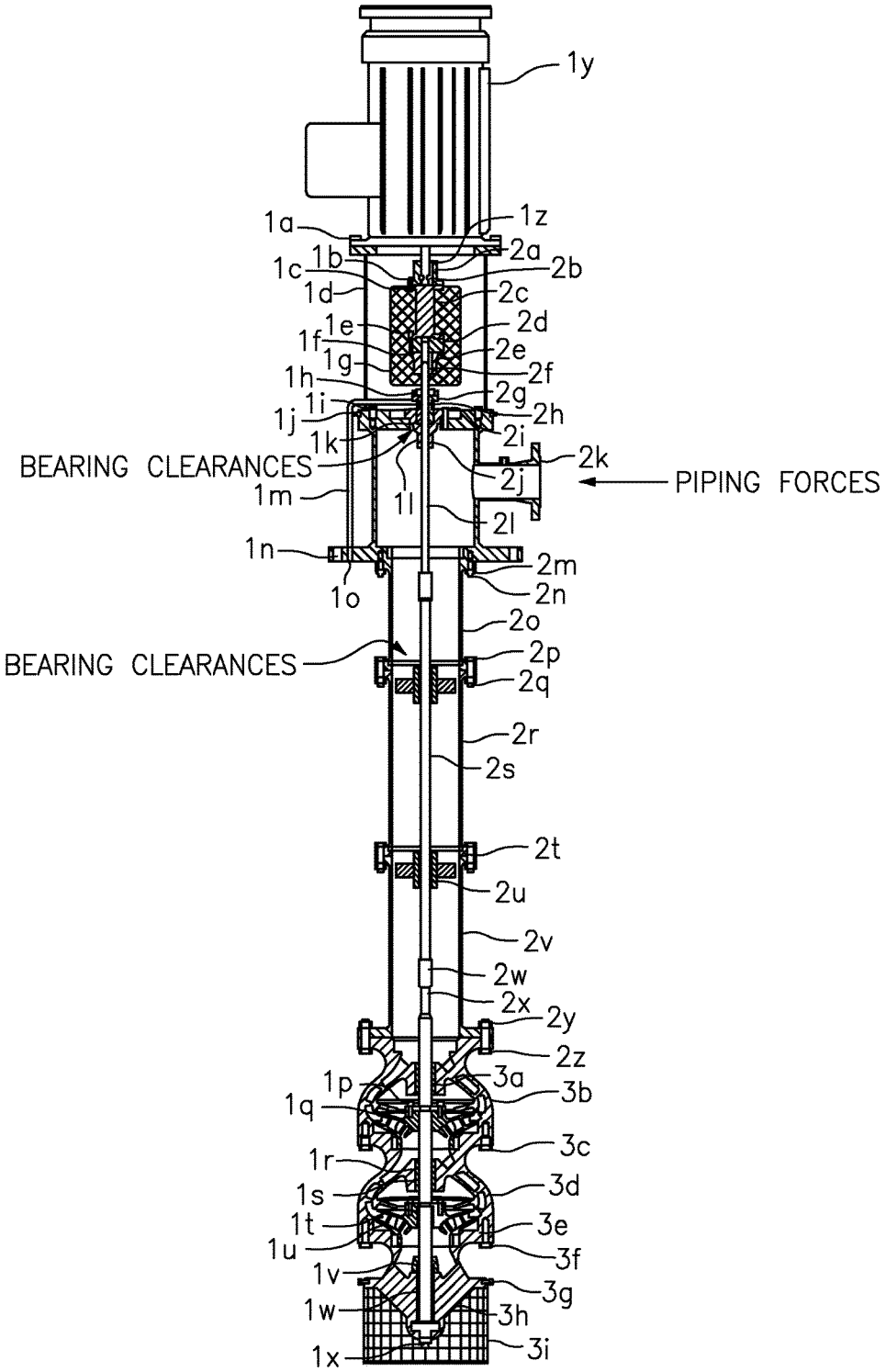
FIG. 1 shows a diagram of an example of one known vertically suspended pump assembly.
Figure 2:
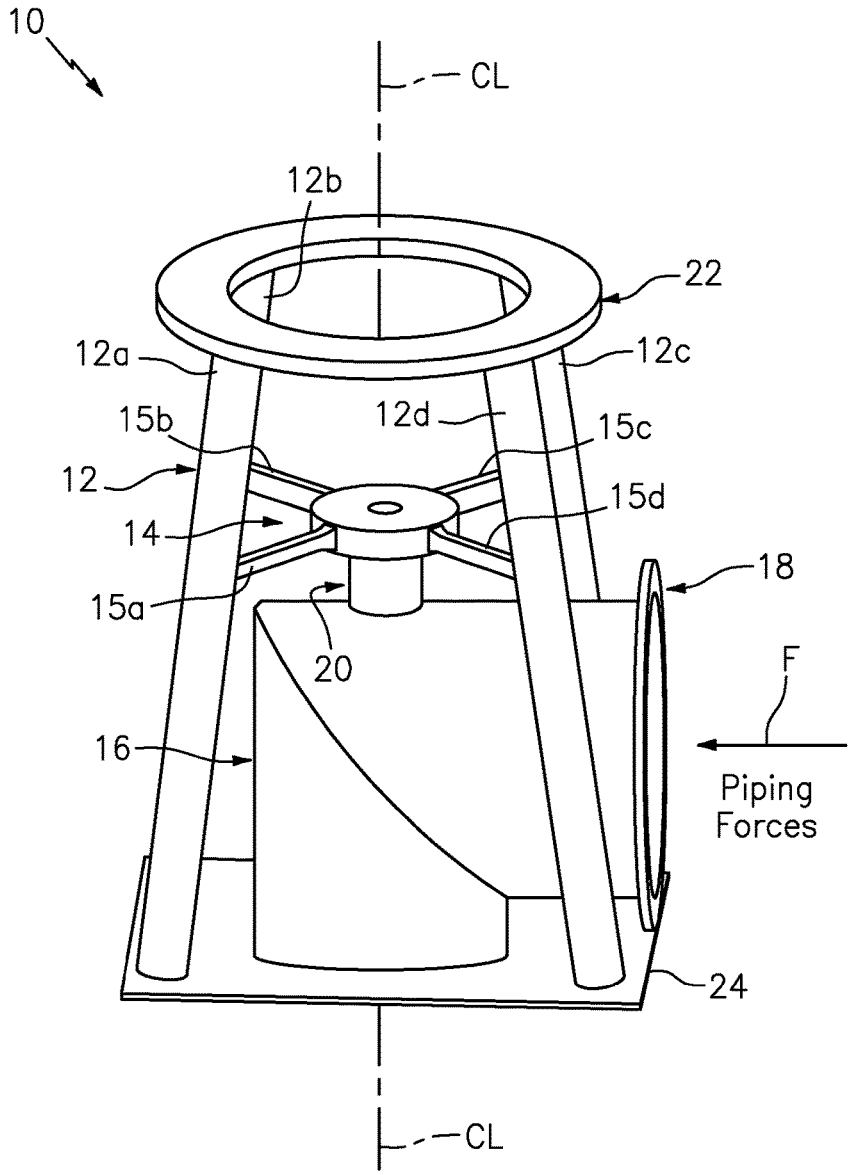
FIG. 2 is a diagram of an example of a new discharge head design according to some embodiments of the present invention.

FIG. 2 shows the new and unique discharge head generally indicated as 10 featuring:

- at least one low-deflection component, e.g., including a combination of a motor support generally indicated as 12 and a bearing housing 14, that substantially does not deflect in response to high piping forces F applied in a direction perpendicular to a centerline CL of the discharge head 10;
- at least one high-deflection component, e.g., including a combination of a discharge elbow 16 and a discharge elbow flange 18, that deflects in response to the high piping forces F; and
- a flexible element 20 configured between the at least one low-deflection component such as elements 12, 14 and the at least one high-deflection component such as elements 16, 18 to contain pressure and to be highly flexible in the direction perpendicular to the centerline CL of the discharge head 10.

The flexible element 20 may be configured, arranged or inserted between the low-deflection components 12, 14 and the high-deflection components 16, 18 so that the deflection of the high-deflection components 16, 18 is not substantially communicated to the low-deflection components 12, 14.

The discharge head 10 may include a mounting plate 22 and a base plate 24. The motor support 12 may be configured with three or more supports, e.g., including four supports 12*a*, 12*b*, 12*c*, 12*d* as shown, that are configured to couple the mounting plate 22 and the base plate 24.

The discharge head 10 may also include three or more rib supports, e.g., including rib supports 15*a*, 15*b*, 15*c*, 15*d* as shown, and the bearing housing 14 may be configured or coupled to the rib supports 15*a*, 15*b*, 15*c*, 15*d* as shown.

The discharge elbow 10 may be configured, coupled or affixed to the base plate 24 as also shown.

Figure 3:
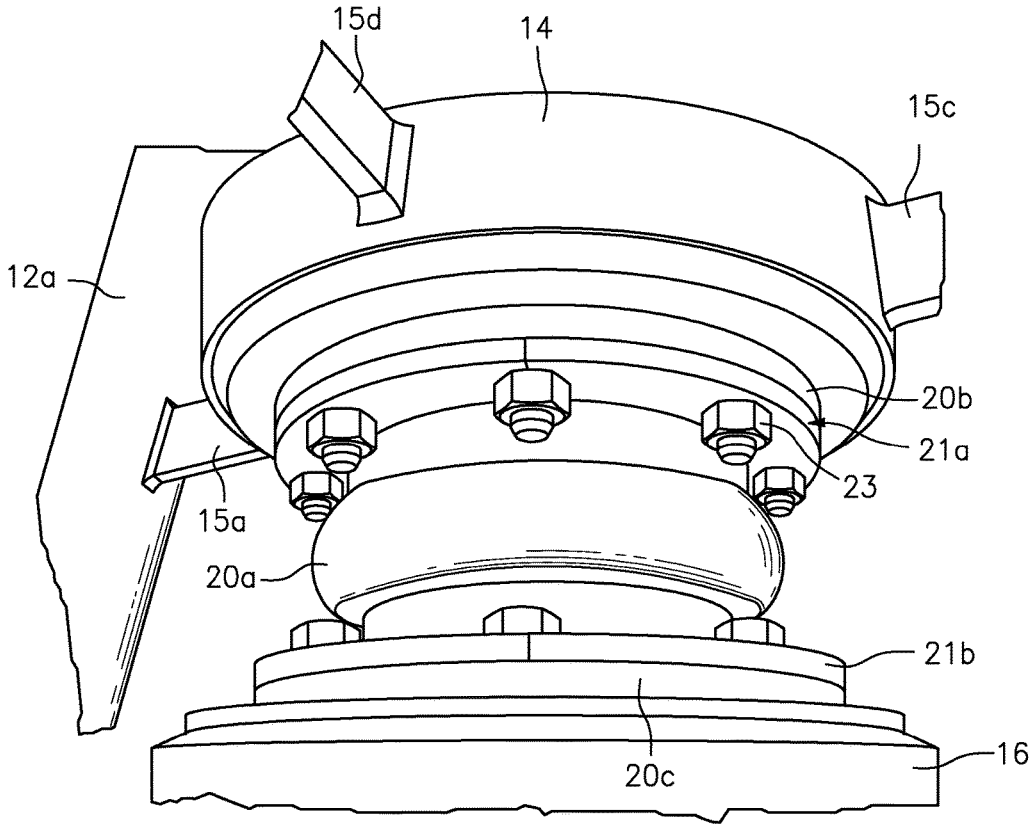
FIG. 3 is a copy of a photograph showing a flexible element that may be configured to form part of the new discharge head design shown in FIG. 2, e.g., in the form of a bellows-like structure arranged between a bearing housing and a discharge elbow of the new discharge head design, according to some embodiments of the present invention.

The flexible element 10 may be configured to couple the bearing housing 14 to the discharge elbow 16 as shown, and consistent for example with that shown in FIG. 3.

By way of example, FIG. 3 shows the flexible element 20 configured in the form of a bellows-like flexible structure 20*a* arranged between the bearing housing 14 and the discharge elbow 16, according to some embodiments of the present invention. According to some embodiments, the bellows-like flexible structure 20*a* may be made from a flexible material such as rubber, although the scope of the invention is intended to include using other types or kinds of flexible materials either now known or later developed in the future.

By way of further example, the bellows-like flexible structure 20*a* may be configured with two flange-like elements 20*b* and 20*c*, and coupling elements 21*a* and 21*b* may be configured to fasten the two flange-like elements 20*b* and 20*c* to the bearing housing 14 and the discharge elbow 16 respectively as shown, e.g., using nut and bolt combinations, one of which is indicated by reference label 23. As shown, the bolts are configured to extend from the bearing housing 14 and the discharge elbow 16, although embodiment are envisioned in which, and the scope of the invention is intended to include, the bolts screwing into the bearing housing 14 and the discharge elbow 16.

Embodiments are also envisioned in which, and the scope of the invention is intended to include, one or more internal metal element (not shown) that may be provided to prevent the bellows-like flexible structure 20*a* from collapsing under certain vacuum conditions.

When the new discharge head 10 is configured in such a vertical pump, the flexible element 20 may be configured so that the internal pump alignment of the vertical pump is substantially maintained, especially in response to the high piping forces, which provides an improvement over prior art discharge heads.

Figure 4A:
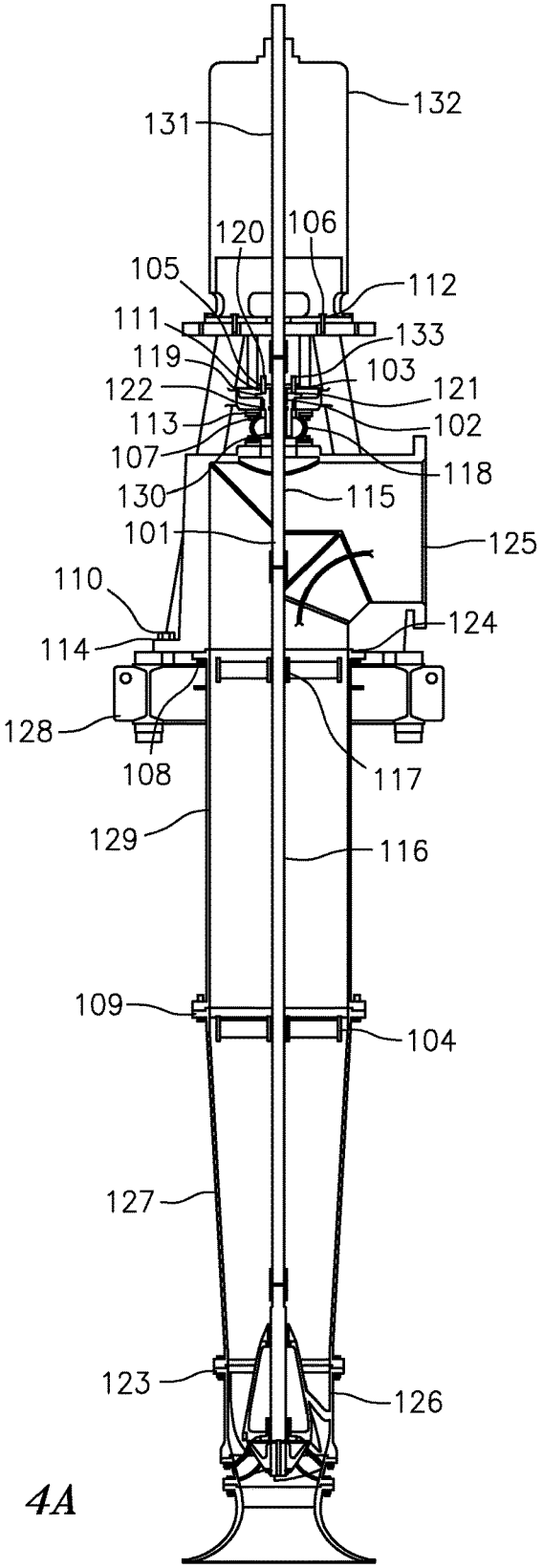
FIG. 4A is diagram of a vertically suspended pump having the new discharge head design incorporated therein, according to some embodiments of the present invention.

FIGS. 4A and 4B

FIG. 4A is diagram of a vertically suspended pump having the new discharge head design incorporated therein, according to some embodiments of the present invention. For example, see the head expansion joint identified by element 118. Moreover, see FIG. 4B showing an index with a list of the components.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What is claimed is:

1. A discharge head (10) for a vertically suspended pump having a motor mounting plate (22) and a base plate (24), comprising:

low-deflection components (12, 14) having a bearing house (14) and a motor support (12) with supports (12*a*, 12*b*, 12*c*, 12*d*) configured to couple the motor mounting plate (22) and the base plate (24), and also having rib supports (15*a*, 15*b*, 15*c*, 15*d*) configured to couple the bearing housing (14) and the supports (12*a*, 12*b*, 12*c*, 12*d*), the low-deflection components (12, 14) configured to respond to high piping forces applied in a direction perpendicular to a centerline (CL) of the discharge head (10) and not substantially deflect;

at least one high-deflection component (16) having a discharge elbow (16) configured to deflect in response to the high piping forces, the discharge elbow (16) being coupled to the base plate (24); and a flexible element (20) configured to couple the bearing housing (14) and the discharge elbow (16) and flex in the direction perpendicular to the centerline (CL) of the discharge head (10) to contain pressure, so that the deflection of the high-deflection components (16, 20) is not substantially communicated to the low-deflection components (12, 14); wherein the flexible element is coupled with horizontal portion of the discharge elbow, and configured as a bellows-like flexible structure; and wherein the flexible element is made from a flexible material, including rubber.

2. A vertical suspended pump comprising:

the discharge head (10) according to claim 1, having the motor mounting plate (22) and the base plate (24);

a first pump arrangement having a vertical solid shaft motor (132) configured for rotating a drive shaft (131);

a second pump combination having a column (127, 129) arranged about the drive shaft (131), and having a bowl assembly (126) with a rotary impeller coupled to the drive shaft (131); and the motor mounting plate (22) configured to couple to the vertical solid shaft motor (132) of the first pump arrangement, and the base plate (24) configured to couple to the column (127, 129) of the second pump arrangement.

* * * * *